US007011430B2

(12) United States Patent
Chen

(10) Patent No.: US 7,011,430 B2
(45) Date of Patent: Mar. 14, 2006

(54) LED ILLUMINATION DEVICE

(76) Inventor: Kai Po Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/807,125

(22) Filed: Mar. 24, 2004

(65) Prior Publication Data

US 2005/0213324 A1 Sep. 29, 2005

(51) Int. Cl.
*F21V 21/00* (2006.01)

(52) U.S. Cl. ..... 362/235; 362/249; 362/800; 362/252

(58) Field of Classification Search ..... 362/800, 362/249, 252, 235, 236, 242, 243, 310, 545
See application file for complete search history.

(56) References Cited

U.S. PATENT DOCUMENTS 5,669,703 A * 9/1997 Wheeler et al. ..... 362/249
6,191,541 B1 * 2/2001 Patel et al. ..... 315/307
2003/0021113 A1 * 1/2003 Begemann ..... 362/231
2004/0022057 A1 * 2/2004 Lee ..... 362/238
2004/0114367 A1 * 6/2004 Li ..... 362/248

* cited by examiner

*Primary Examiner*—Thomas M. Sember
(74) *Attorney, Agent, or Firm*—Leong C. Lei

(57) ABSTRACT

An LED illumination device which includes a transparent lamp hood, a light-reflective hood, a first circuit board mounted on the light reflective hood, a transparent base housing engaged with the transparent lamp hood, a second circuit board mounted within the transparent base housing, and a bulb seat engaged with a lower end of the transparent base housing. The first circuit board has a top on which are mounted a plurality of LEDs. The the first circuit board covered by the transparent lamp hood. The light reflective hood is fitted in the transparent base housing. The second circuit board has a top on which are mounted a plurality of LEDs which are positioned in a biased angle. The first circuit board has a conductive wire passing through the central through hole to connect with a conductive wire of the second circuit board.

1 Claim, 5 Drawing Sheets

LED ILLUMINATION DEVICE

BACKGROUND OF THE INVENTION (a) Technical Field of the Invention

The present invention relates to LEDs, and in particular, to an LED illumination device which is mounted by a light-reflective hood so that a larger light projection area is obtained.

(b) Description of the Prior Art

Conventional light bulbs for vehicles normally use tungsten bulbs, and recently, in order to extend longevity and to save current, LEDs are used to extend their longevity for long hours of operation. In view of methods of light emission between the LED and tungsten bulbs, LED provides direct light projection and the tungsten bulbs provide a fan-shape illumination. The LED bulbs employed in vehicles have a direct light projection and insufficient brightness, and so a number of LED bulbs have to be used to achieve the desired effect. This drawback is also found in home appliances where a light-reflective hood is mounted onto the LED. In view of this, the hood installation is problematic if LED is employed. Thus, the application of LED is not popular in home.

The light of an LED is characterized in that if the angle of illumination is smaller, the illumination will be brighter, and therefore, the LED will not provide a fan-shaped light source. The angle of illumination of LED can be improved by modifying the structure of the LED bulb. U.S. patent application Ser. No. 434,510 discloses an improved structure by mounting a plurality of LEDs on the circuit board and the lower edge of the circuit board is stepped so that the light source from the LED is reflected by a lamp hood. However, the light source after reflected from the lamp hood is weaker and the brightness is insufficient, and the fan-like light projection of the tungsten bulb cannot be achieved. Accordingly, it is an object of the present invention to provide an LED illumination device which mitigates the above drawbacks.

SUMMARY OF THE INVENTION

Accordingly, it is an object of the present invention to provide an LED illumination device comprising a light-reflective hood, two circuit boards, a plurality of LEDs, a lamp hood, a base housing and a lamp seat, characterized in that the upper edge of the light-reflective hood is provided with a plurality of LEDs and a conductive wire at the lower section of the hood is passed through the through hole of another circuit board and the surrounding LED forms into a biased angle, the bottom section of the hood is engaged with a transparent base housing, and the upper edge of the base housing body is adhered to a lamp hood, and the conductive wire at the lower section of the circuit board is connected to the wire of the lamp seat at the base housing.

Yet still another object of the present invention is to provide an LED illumination device, wherein the lamp seat and the lamp hood are replaceable with lamp seat and lamp hood of various shapes.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
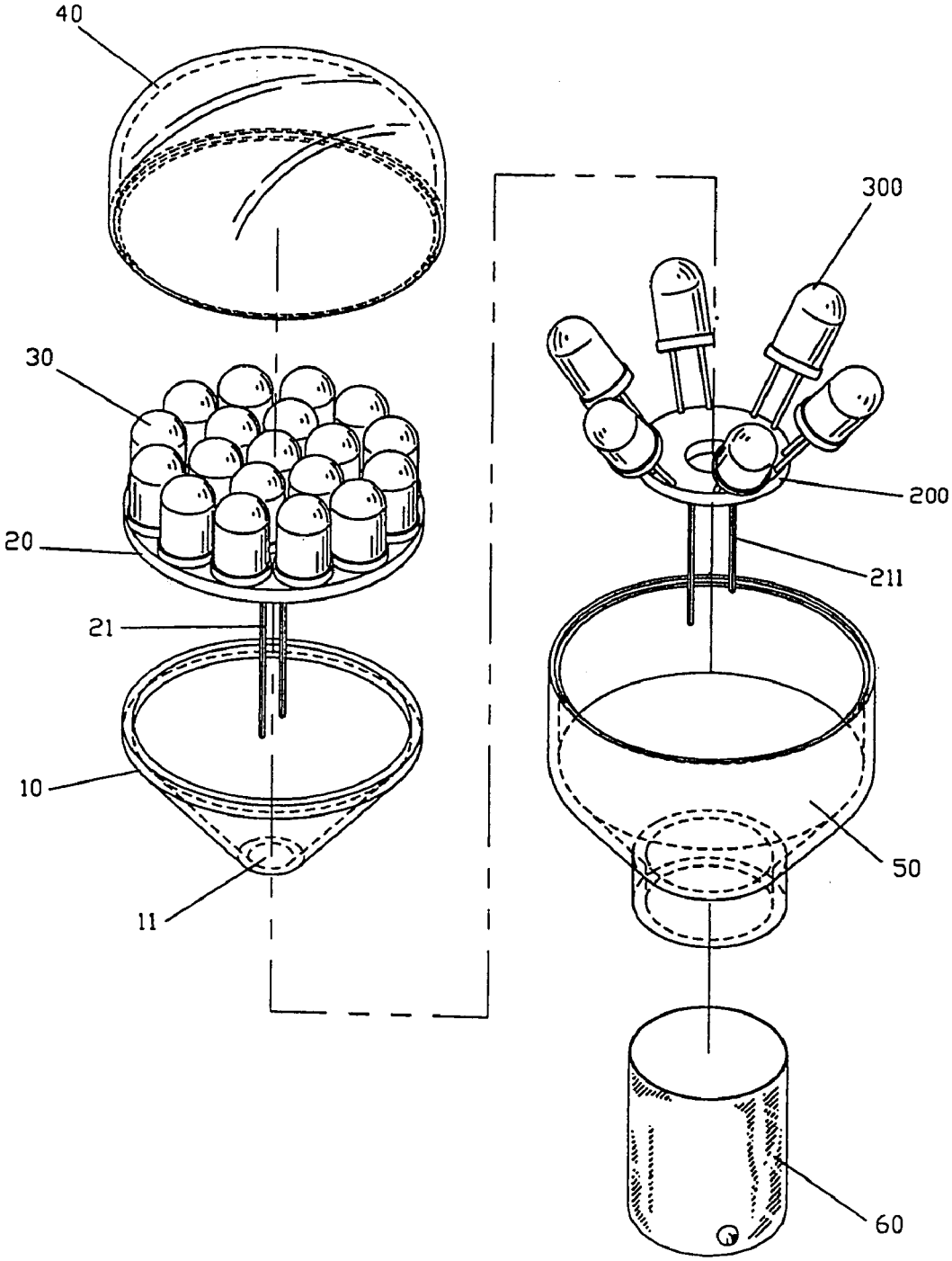
FIG. 1 is a perspective view of an LED illumination system in accordance with the present invention.

The present invention relates to FIG. 1 which shows an LED illumination device having a funnel shaped light-reflective hood 10 mounted with a circuit board 20 on the top of the hood 10. A conductive wire 21 linked to the lower section of the circuit board 20 is passed through the central through hole 11 of the light-reflective hood 10 after a plurality of LEDs 30 have been mounted to the circuit board 20. The conductive wire 21 is connected to a wire 211 of a circuit board 200 mounted to a bulb seat 60. On the circuit board 20 are mounted a plurality of LEDs 30. The circuit board 20 is installed on the funnel shaped light-reflective hood 10. The top of the circuit board 20 is covered with a transparent lamp hood 40 which is engaged with a base housing 50 to form into a single unit. Finally, the bottom section is mounted with the bulb seat 60 to form a wiring connection.

Figure 2:
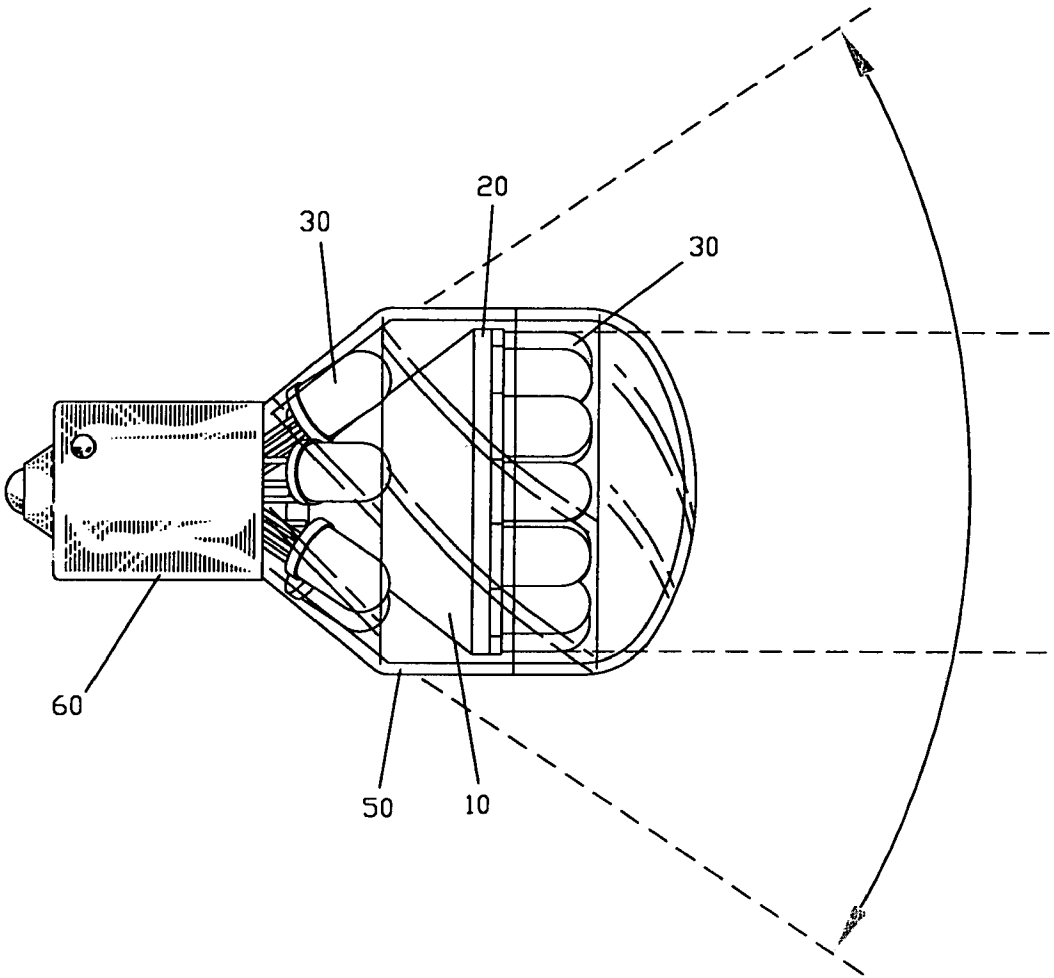
FIG. 2 is a schematic view showing the range of light source projection in accordance with the present invention.

As shown in FIG. 2, there is shown the projection range of a light source. The surrounding of the circuit board 20 on the upper section of the bulb seat 60 is provided with a plurality of LEDs 30, and it is then mounted with, in sequence, a funnel shaped light-reflective hood 10 and a transparent base housing 50 so that the LEDs are biased at an angle. The LEDs 30 projects light directly and the LEDs, after mounted in a circular shape, provide externally, a projected fan-shape light source. This will effectively increase the projection area of light and the projection method is close to the traditional tungsten bulb. At the same time, the projected brightness of the light source is enhanced so that the longevity of LED is increased.

Figure 3:
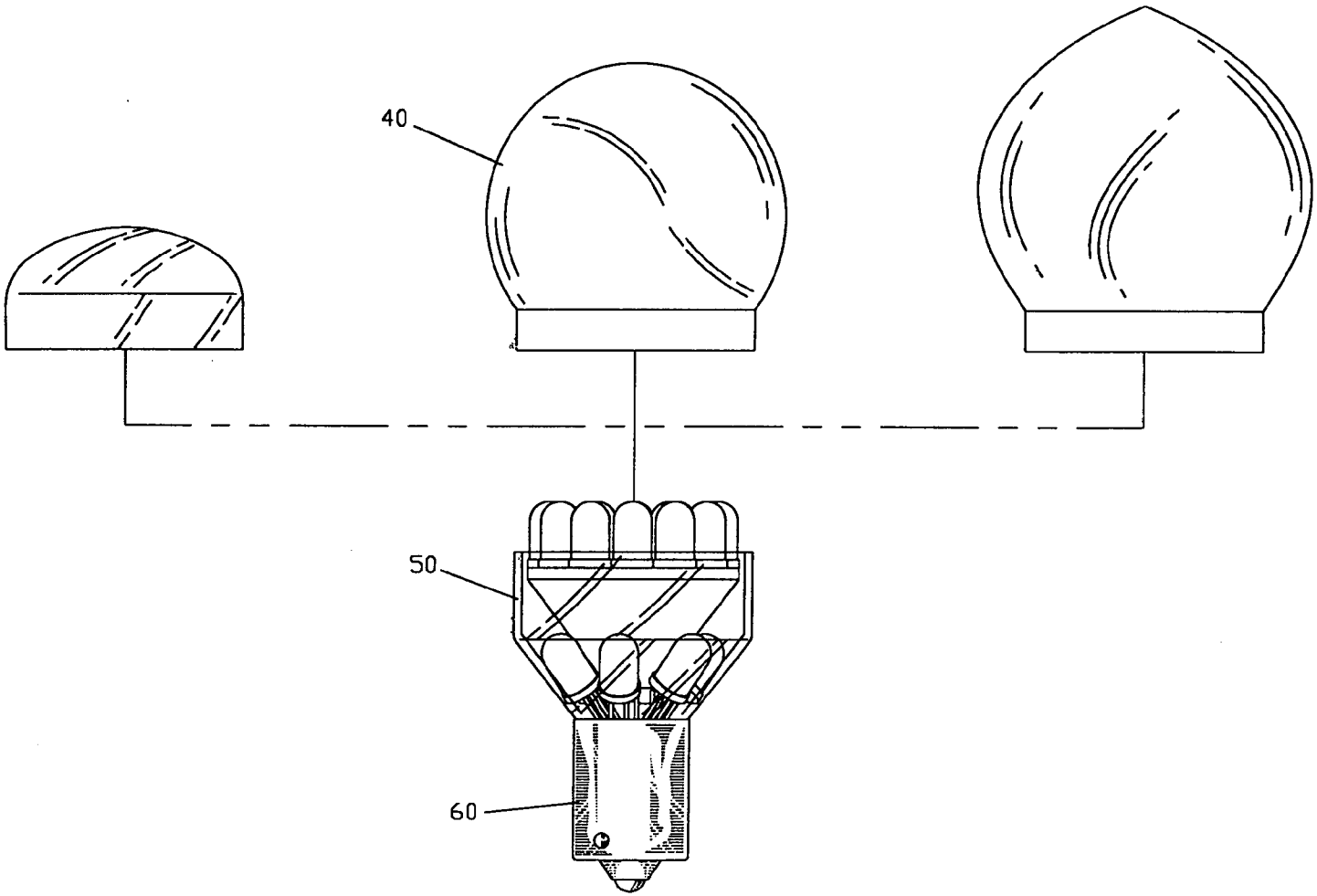
FIG. 3 is a schematic view of a hood in accordance with the present invention.
Figure 4:
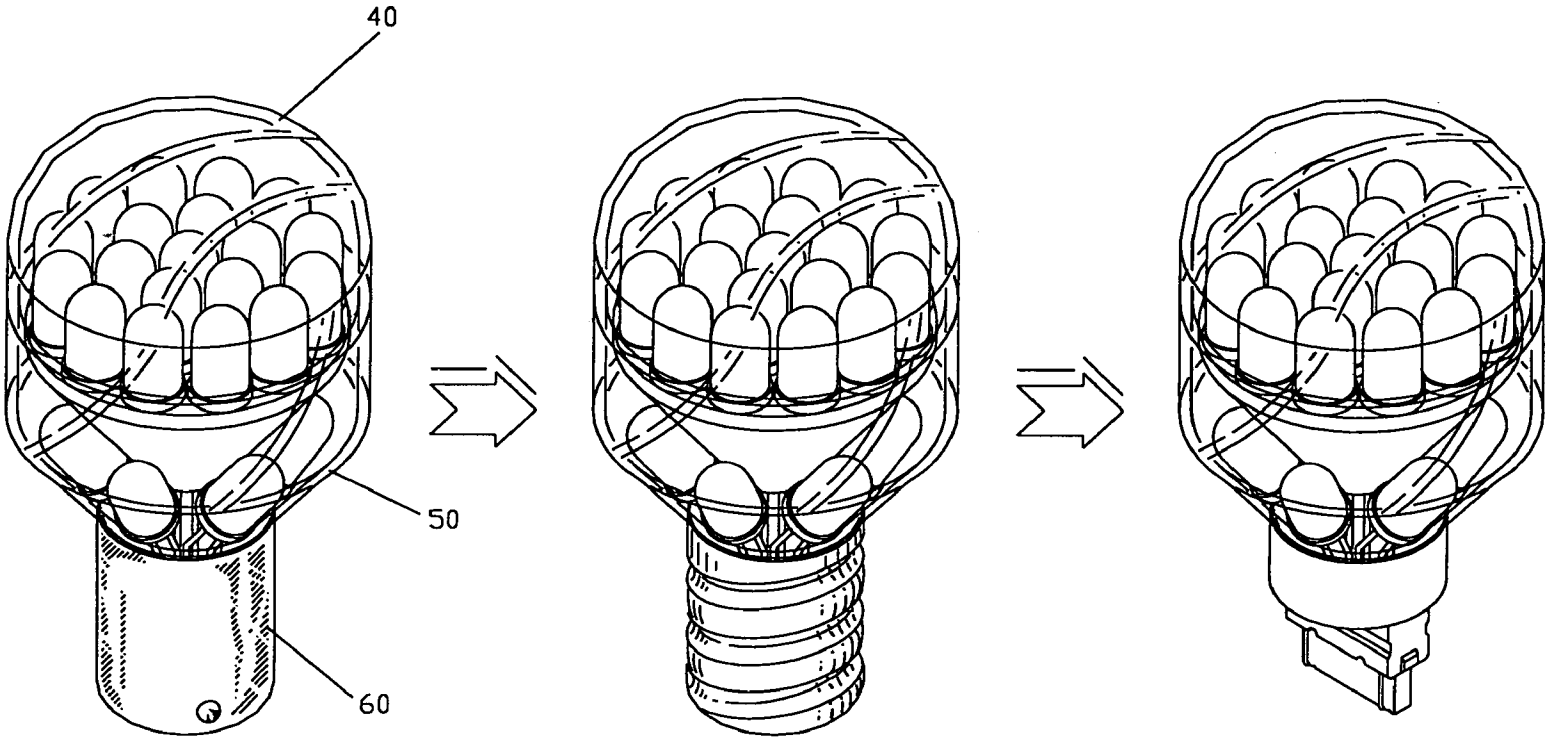
FIG. 4 is a schematic view of the lamp seat of the present invention.
Figure 5:
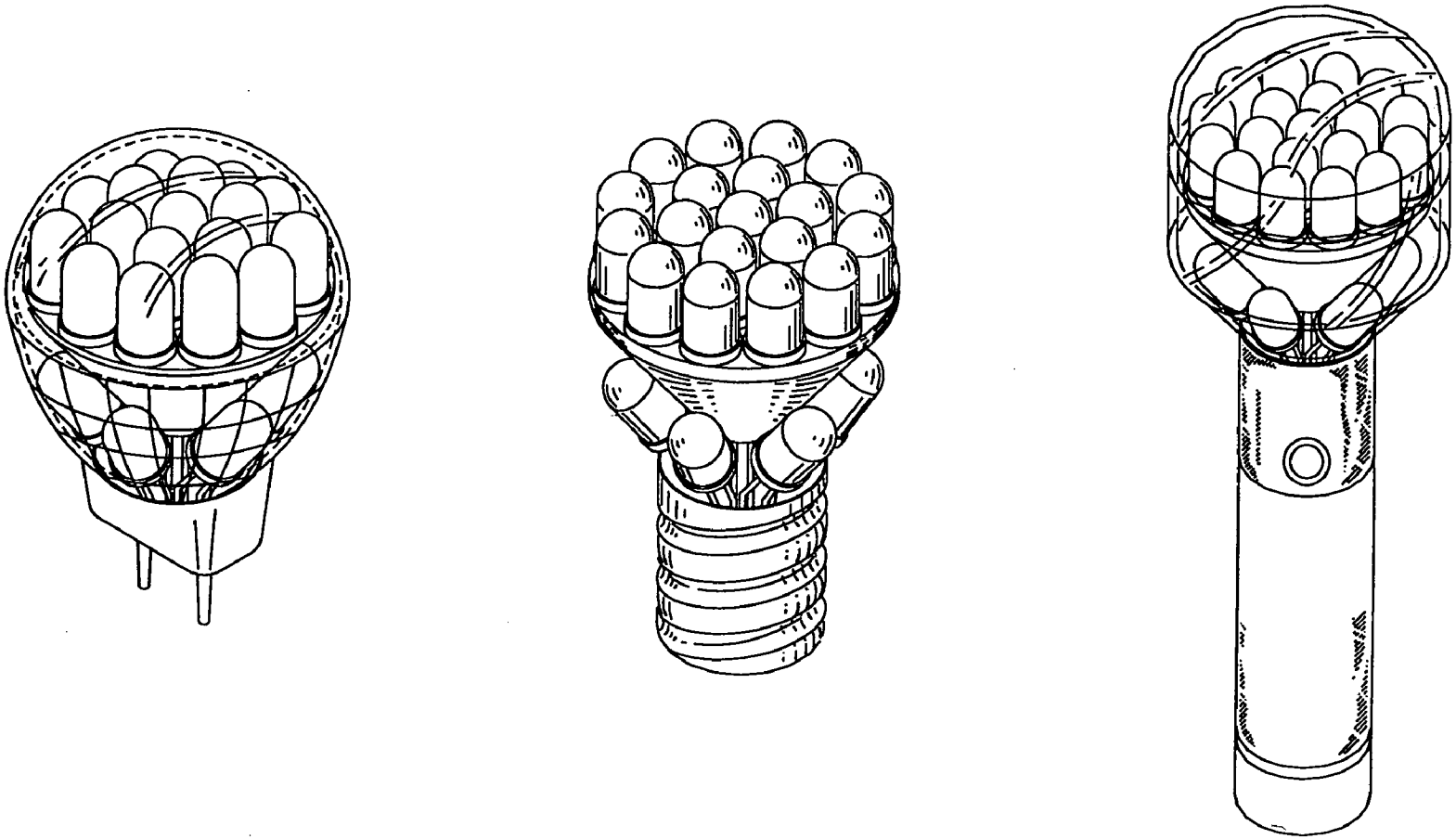
FIG. 5 is another schematic view of the lamp seat of the present invention.

As shown in FIGS. 3–5, the lamp hood 40 can be made of various shapes so as to change the external aesthetic effect, and the lamp seat 60 at the bottom housing can also be charged to use in home illumination, in vehicle or torch.

The advantages of the present LED illumination device are as follows:

(i) Current-saving, and longevity.

(ii) Durable at constant temperature.

(iii) The range of radiation is close to traditional bulb.

(iv) Wide illumination area.

Hence, the present LED illumination device overcomes the drawback of insufficient brightness of LED bulbs.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An LED illumination device comprising:

a transparent lamp hood;

a light-reflective hood having a central through hole;

a first circuit board mounted on said light reflective hood, said first circuit board having a top on which are mounted a plurality of LEDs, said first circuit board being covered by said transparent lamp hood;

a transparent base housing engaged with said transparent lamp hood, said light reflective hood being fitted in said transparent base housing;

a second circuit board mounted within said transparent base housing and positioned under said light-reflective hood, said second circuit board having a top on which are mounted a plurality of LEDs which are positioned in a biased angle;

said first circuit board having a conductive wire passing trough said central through hole to connect with a conductive wire of said second circuit board; and a bulb seat engaged with a lower end of said transparent base housing.

* * * * *